United States Patent [19]

Stahlecker et al.

[11] 4,096,686

[45] Jun. 27, 1978

[54] FEED DEVICE FOR OPEN-END SPINNING ASSEMBLY

[75] Inventors: Fritz Stahlecker, Bad Überkingen; Hans Raasch, Mönchengladbach, both of Germany

[73] Assignees: Fritz Stahlecker; Hans Stahlecker, both of Germany

[21] Appl. No.: 777,561

[22] Filed: Mar. 14, 1977

[30] Foreign Application Priority Data

Apr. 2, 1976 Germany ..... 2614182

[51] Int. Cl.[2] ..... D01H 1/12

[52] U.S. Cl. ..... 57/58.95

[58] Field of Search ..... 57/58.95, 58.91

[56] References Cited

U.S. PATENT DOCUMENTS

| | | | |
|---|---|---|---|
| 3,571,859 | 3/1971 | Doudlebsky et al. | 57/58.95 X |
| 4,014,162 | 3/1977 | Stablecker | 57/58.95 |

*Primary Examiner*—Richard C. Queisser

*Assistant Examiner*—Charles Gorenstein

*Attorney, Agent, or Firm*—Craig & Antonelli

[57] ABSTRACT

Feeding apparatus is provided for an open-end spinning assembly which includes a feeding table and feed roller facing one another to form a nip which offers sliver to an opening roll disposed downstream thereof. Upstream of the feed roll and feeding table ther is provided a sliver funnel which has an outlet opening facing the feed table and feed roller. In order to accommodate correct laying of the sliver in the sliver funnel so that it is properly disposed with respect to the feeding apparatus, the sliver funnel is disposed and configured so that the outlet opening thereof is visually exposable without opening the housing for the feed roll and feed table. According to preferred embodiments, the sliver funnel is mounted for movement between an in-use position and a servicing position, with the outlet opening being visible when in the servicing position so as to accommodate laying in of the sliver.

27 Claims, 11 Drawing Figures

FEED DEVICE FOR OPEN-END SPINNING ASSEMBLY

BACKGROUND AND SUMMARY OF THE INVENTION

The invention relates to a feed device for open end spinning assemblies. Preferred embodiments relate to such a feed device for delivery of sliver to an opener with a conveyor device disposed in a housing, said conveyor device forming a nip for the sliver presented to the opener, upstream of which there is an intake funnel.

The use of a feed roll as conveyor is known (German OS 2,029,878), against which roll a feed table with spring means is applied. It is also known that a pressure roll may be used instead of a feed table (German OS 2,136,178). In a construction of this kind the conveyor has an upstream intake funnel which leads the sliver to the feed roll. It is also known (German patent No. 1,560,330, German OS 2,134,342) that a feed table may be combined with an intake funnel. It is common to all of these constructions that the feed roll and the intake funnel are disposed in a housing that is closed, up to the zone of the feed opening of the intake funnel, to prevent the entry of infiltrated air. This of necessity has the effect that the opening of the intake funnel that is turned toward the feed roll is disposed within the housing. In practice therefore it is not possible to observe this opening of the intake funnel, to determine whether or not the sliver is correctly placed. This makes placing of the sliver difficult and may occasion sources of defects.

The problem to which the invention is addressed is to so create the feed device for open end spinning assemblies of the mentioned type that the placing of the sliver will be facilitated and also be observable by the operator, so that he may see that the sliver is laid in correctly. The invention contemplates providing that the intake funnel is so disposed and/or constructed that at least its outlet opening that leads to the conveyor can be exposed without opening the housing.

By virtue of this construction it is possible to effect the placement of the sliver precisely and thereby to observe whether or not the sliver has reached the outlet opening of the intake funnel, so that it is reliably guided to the feed roll.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
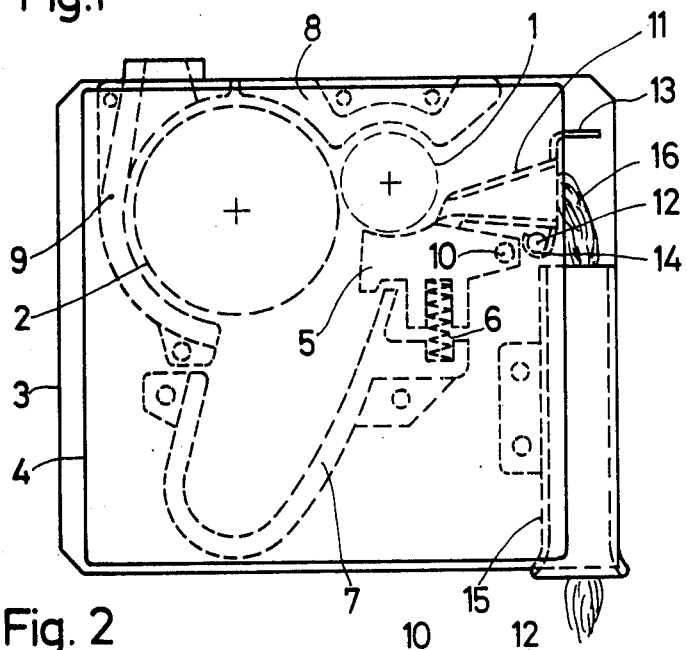
FIG. 1 is a front schematic view of a feed device for an open end spinning assembly constructed in accordance with a preferred embodiment of the invention.

FIG. 1 shows a feed device for feeding the sliver that is to be spun, in the operating state. A feed roll 1 and a faster running opener roll 2 are disposed in a housing 3 that is closed at the front side of feed roll 1 and opener roll 2, with a cover 4. A feed table 5, swingable about a shaft 10, is associated with feed roll 1, said table being pressed by a spring 6 against feed roll 1, and in a known way, along with the feed roll it forms a nip for the sliver, said sliver being combed out by opener roll 2 and opened into individual fibers. Spring 6 bears against a housing part 7 that constitutes a chamber for receiving impurities that are separated from the opened sliver. Housing 3 has a housing part on the opposite side, for sealing against infiltrated air, and in the region of opener roll 2 it has another housing part 9 that constitutes part of a feed passage for the opened fibers, by which the fibers are delivered to a spinning rotor.

Upstream of feed roll 1, inside housing 3, there is an intake funnel 11 for sliver 16, which is held swingably by means of a guide 14 on a shaft 12 that is parallel to feed roll 1. Intake funnel 11 which is urged by a spring element that is not illustrated, with the region of its outlet opening against feed table 5, is supposed to compact the sliver 16 somewhat, which is to be delivered to feed roll 1, and to guide it in the region of the nip between feed roll 1 and feed table 5. In the illustrated example, sliver 16 is carried upstream of intake funnel 11 through a guide tube 15.

Figure 2:
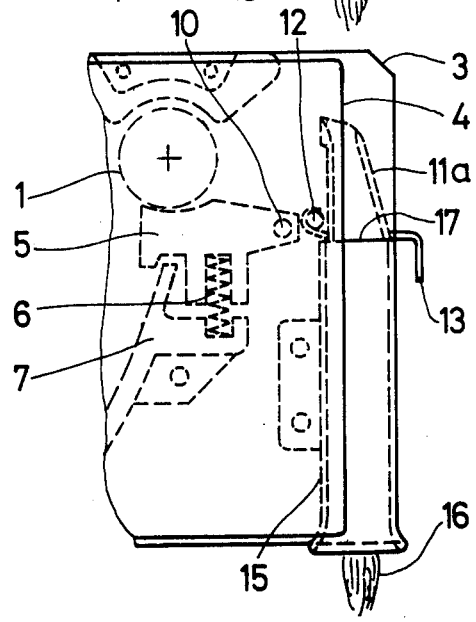
FIG. 2 is a partial view of the device of FIG. 1 in a servicing position.

There is always a certain difficulty in guiding sliver 16 into intake funnel 11 in such a way that it will reliably reach the nip between feed roll 1 and the feed table if, as is customary, feed roll 1 cannot be seen by the operator. The difficulty in laying in sliver 16 is further increased in this case because sliver 16 has to be deflected by about 90° in its direction of travel, between guide tube 15 and intake funnel 11. For this reason there is provision as illustrated in FIG. 2 of an arrangement whereby intake funnel 11 can be swung about shaft 12 into threading-in position 11*a*. Intake funnel 11 is then applied with its intake opening 17 on the mouth of guide tube 15 in such a way that there is a largely straight path for sliver 16 through guide tube 15 and intake funnel 11. It is then possible simply to introduce sliver 16 from below, first into guide tube 15 and subsequently into intake funnel 11. Guide tube 15 is outside housing 3 that is bounded by cover 4, from which housing intake funnel 11 is swung out in the region of an opening, so that the operator can observe sliver 16 as it issues from the outlet opening of intake funnel 11. To swing intake funnel 11 into threading-in position 11*a* and back again into its operating position of FIG. 1, there is a grip 13 which moreover can be so disposed, standing out of the plane of the drawing, that it will not be hampered by adjacent spinning stations. In swinging back into the operating position, intake funnel 11 carries along the sliver that is lightly held in the region of the outlet opening and transfers it to the transport device comprised by feed roll 1 and feed table 5.

Figure 3:
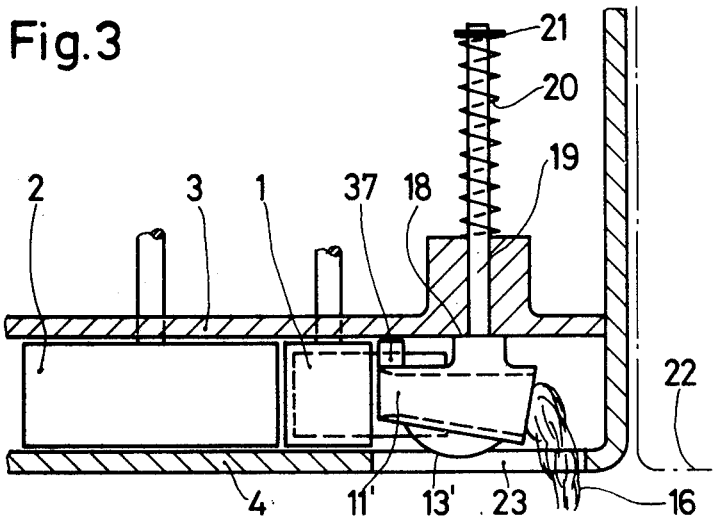
FIG. 3 is a sectional view through a feed device of an open end spinning machine constructed in accordance with another preferred embodiment of the invention.
Figure 4:
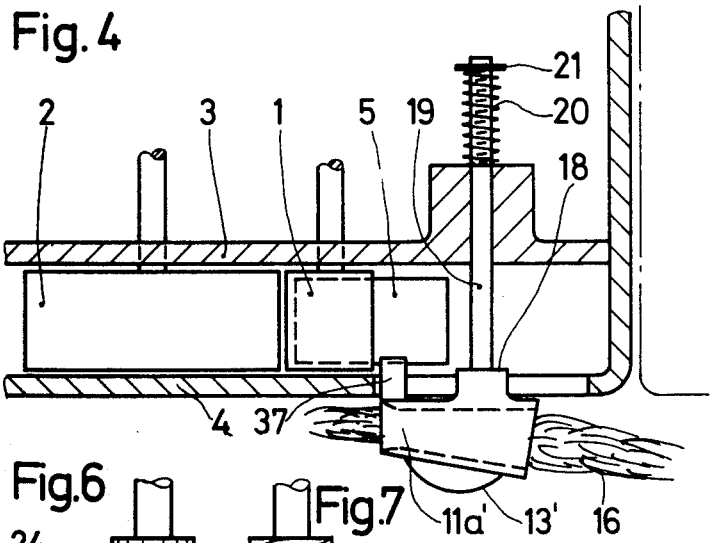
FIG. 4 shows the embodiment of FIG. 3 in the servicing position.
Figure 5:
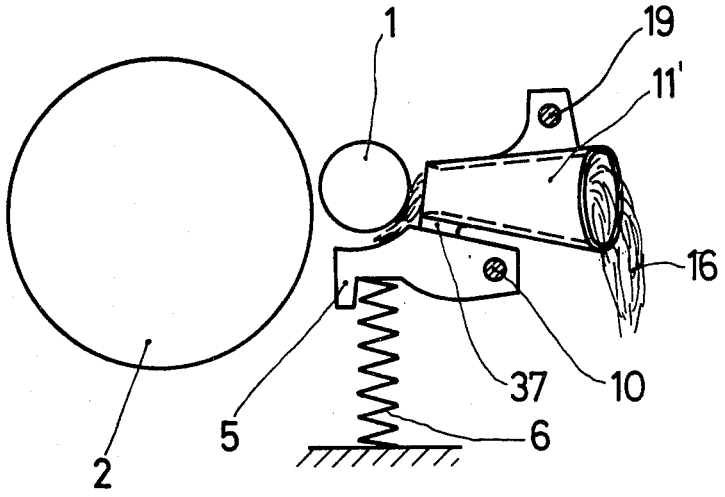
FIG. 5 is a partial front schematic view of the embodiment of FIGS. 3 and 4.

In the embodiment of FIGS. 3, 4 and 5, there is also an intake funnel 11' upstream of a feed roll 1 and an opener roll 2, disposed in a housing 3, which in the region of the front side of feed roll 1 and opener roll 2 has a housing part that serves as a cover, which cover presents an opening 23 in the region of intake funnel 11'. The adjacent spinning assembly is indicated in dot-and-dash lines at 22. In this case also, laying in of sliver 16 is made difficult because the sliver is fed in from the front (from below in the drawing) and then has to be deflected by almost 90° toward feed roll 1. To facilitate introduction of sliver 16, it is provided that intake funnel 11' can be drawn out through opening 23 from housing 3 for introduction of the sliver. For this, a slide rod 19 is disposed on intake funnel 11', which is seated slidably in a suitable guide in housing 3. A compression spring 20 is laid around slide rod 19, which spring bears on the one hand on a ring 21 disposed on the end of rod 19, and on the other hand against a shoulder on housing 3. In this way, intake funnel 11 is held in its operating position, where it bears with its shoulder 18 against the back wall of housing 3. To lay in sliver 16, according to FIG. 4, intake funnel 11 can be withdrawm from housing 3 into a threading-in position **11*a* (with use of) grip 13'. It is now possible to lay in sliver 16 from the side, into the intake funnel, whereof the inner uniformly tapering guide passage — in top view — is directed slightly at a slant toward the feed roll, so that in the operating state (FIG. 3) sliver 16 can be well pulled in. Introduction of sliver 16 into intake funnel 11' can readily be checked on by the operator, at the outlet opening. With release of intake funnel 11', this member returns to its operating position of FIG. 3, urged by spring 20**.

In the operating position, intake funnel 11' is applied (FIG. 5) onto feed table 5 by a lug 37. In order that this position may not be disturbed when intake funnel 11' is in its servicing position **11*a'* for threading in of sliver 16, lug 37 is advantageously elongated to the side. It is then possible by loading intake funnel 11', e.g. on grip 13', to lift feed table 5 from feed roll 1 enough that the end of sliver 16 protruding from the outlet opening of intake funnel 11' may readily run in between feed roll 1 and feed table 5. It is advantageous here if opening 23 is extended in the direction of sliver travel enough so that the drawing in of sliver 16 will not be hindered. The elongation of opening 23 can be limited to this region so that penetration of infiltrated air will not be promoted. The slide rod guide in the embodiment of FIGS. 3 to 5 allows relatively simple line-up operations which ensure that neither the operating position (FIG. 3) nor the servicing position (FIG. 4) can be left until stresses brought on by the line-up operations have been overcome. This further facilitates the work of threading in sliver 16 into intake funnel 11**.

Figure 6:
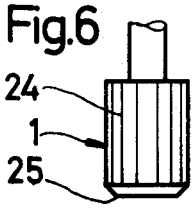
FIGS. 6 and 7 are partial views showing details of the embodiment of FIGS. 3 to 5.
Figure 7:
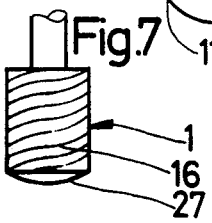

In addition, according to FIG. 6, feed roll 1 may be given a distinct bevel 25 on the side turned toward opening 23, thereby facilitating the drawing in of the end of sliver 16. Normally feed roll 1 has a linear fluting 24. However as in FIG. 7 this grooving 26 may be helicoidal, to facilitate introduction of the end of sliver 16 when intake funnel 11 moves back into its operating position.

Figure 8:
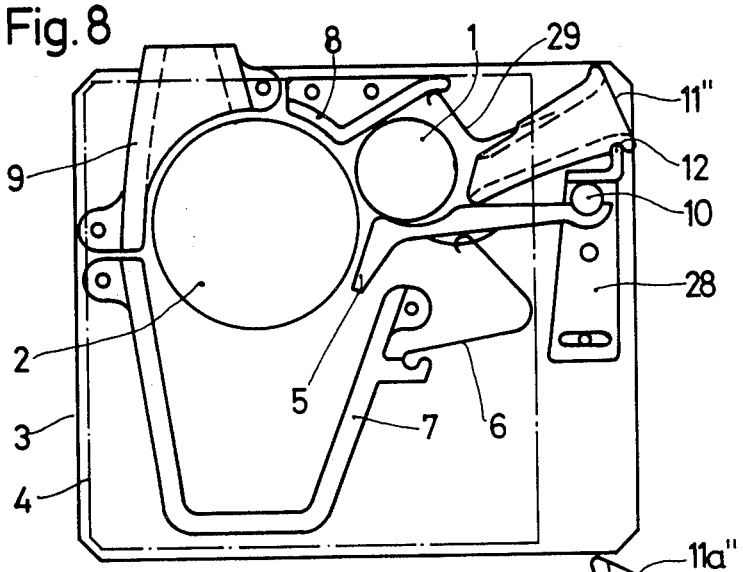
FIG. 8 is a front view of still another embodiment of the invention with the feed device in an operating position.
Figure 9:
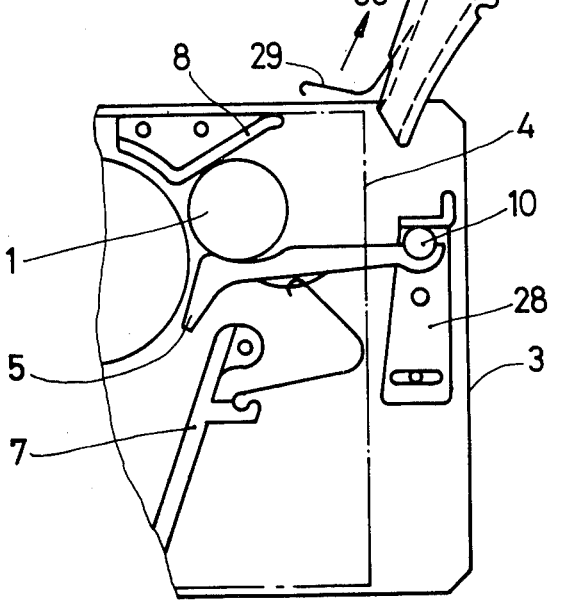
FIG. 9 is a partial view of the embodiment of FIG. 8 with the feed device in the servicing position.

FIG. 8 shows an embodiment where intake funnel 11'' can be taken off entirely, to lay in sliver 16. In the operating position (FIG. 8) intake funnel 11'' bears against a rib 12 of a holder 28 and against feed table 5, on which it is pressed by spring 29 applied on housing part 8. Feed table 5 is swingably borne about a shaft 10 which can be made as a sphere, and is pressed by a spring 6 against feed roll 1. Intake funnel 11'' is readily removable because for example it can be pulled out upward in the direction of arrow 30 (FIG. 9 position **11*a''*), whereafter the laying in of the sliver can be readily effected, in a way that is easily checked on. Then intake funnel 11'' is put back in its operating position of FIG. 8, where it locks because its depression engages rib 12**.

Figure 10:
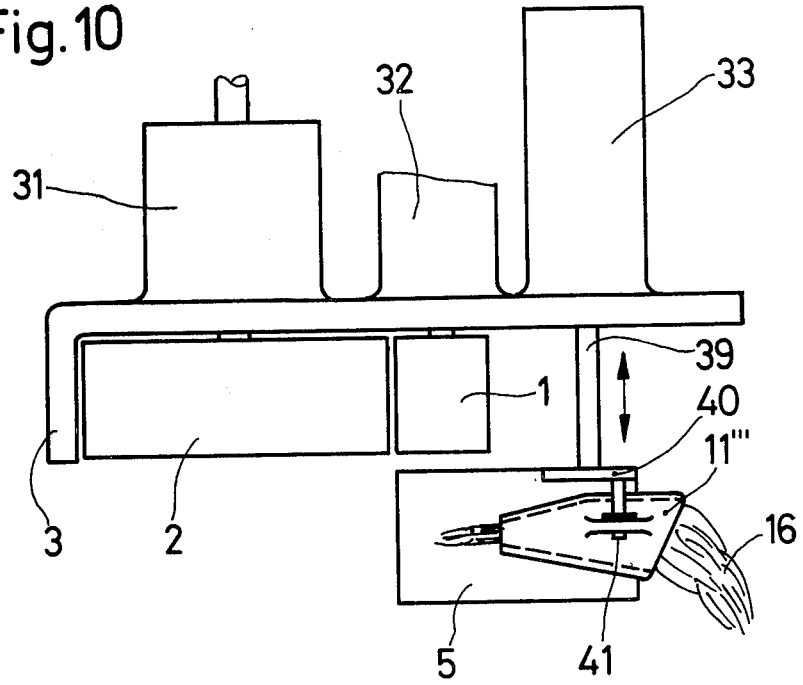
FIG. 10 is a top schematic view of another embodiment of the invention.

FIG. 10 shows an embodiment in which housing 3 has projections 31, 32, 33 like annular collars, which accept the bearing of opener roll 2 and feed roll 1 as well as a slide rod 39. Slide rod 39 supports a feed table 5 that is swingable about the long axis of the said rod, the table being furnished with a projection 40 whereon a run-in funnel is suspended by means of a pin 41. In this embodiment it is therefore provided that feed table 5 associated with feed roll 1 may be pulled out with funnel 11''', so that the fibers of sliver 16, in the introduction and swinging of feed table 5, will come immediately to lie under feed roll 1. The opening in the cover (not illustrated) of housing 3 must then be large enough so that the feed table too can be pulled out through it. In certain circumstances it is then advisable, at least for this region, to furnish an auxiliary cover that will cover this area and possibly be applied to feed table 5 also.

Figure 11:
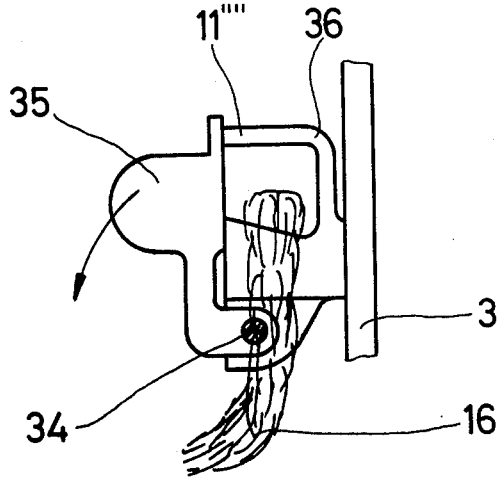
FIG. 11 is a schematic view of an embodiment of an intake funnel of a feed device constructed according to the invention.

In the embodiment of FIG. 11 it is provided that intake funnel 11'''', disposed upstream of a transport device constituted by a feed roll and a feed table, corresponding to previous embodiments but not illustrated here, will be accessible over its whole width through an opening or cutout in housing 3, which is only partly shown in the drawing. It comprises two parts 35 and 36, in such a way that the inner guide passage that they form can be opened over its whole length, to lay in a sliver 16. Part 36 has an essentially U-shaped cross section, open to the side, and closed by part 35 which is like a cover. The coverlike part 35, with a handle, is swingably articulated about a shaft 34, on part 36. It is spring-loaded in a way that is not illustrated, so that it is pressed into its closed position. Only a small manufacturing outlay is involved in this embodiment, while in addition there is the advantage that housing 3 needs not undergo any modification.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Feeding apparatus for a spinning assembly comprising:

a transport arrangement for delivering sliver to an opener device and which forms a nip for the sliver presented to the opener device, a housing surrounding said transport arrangement, a sliver funnel disposed upstream of said transport arrangement, said sliver funnel having an outlet opening which leads to the transport arrangement, and sliver funnel guide means for supportably guiding said sliver funnel for movement between an operating position with said outlet opening in the vicinity of the transport arrangement and a servicing position with said outlet opening exposed to the outside of said housing for accommodating visual inspection of the position of the sliver inserted in the sliver funnel without requiring opening of said housing, said sliver funnel guide means including means for supporting said sliver funnel in each of its operating and servicing positions, whereby sliver can be laid correctly in said sliver funnel without requiring opening of said housing for the transport arrangement.

2. Apparatus according to claim 1, wherein said spinning assembly is an open-end spinning assembly.

3. Apparatus according to claim 2, wherein the housing has an opening through which the sliver funnel is accessible from the outside.

4. Apparatus according to claim 3, wherein the sliver funnel is movable out of the housing through the opening from said operating position to said servicing position for accommodating the threading in of the sliver.

5. Apparatus according to claim 4, further comprising a stationary sliver feed tube disposed upstream of the sliver funnel, and wherein said sliver funnel is movable from its operating position into its servicing position where it lies as an extension of the stationary feed tube.

6. Apparatus according to claim 4, wherein said transport arrangement includes a feed table and a feed roll, and wherein the sliver funnel and feed table and feed roll constitute a structural unit that is movable out of the housing by way of a slide rod which holds them, said slide rod forming a part of said sliver funnel guide means.

7. Apparatus according to claim 4, wherein elastic means are provided for holding the sliver funnel in its operating position.

8. Apparatus according to claim 4, wherein securing aligning means are provided for securing the sliver funnel in its servicing position, said servicing aligning means forming part of said sliver funnel guide means.

9. Apparatus according to claim 4, wherein said transport arrangement includes a feed roll and a feed table that is urged by spring elements against the feed roll, on which feed table the sliver funnel is applied in its operating position.

10. Apparatus according to claim 2, wherein elastic means are provided for holding the sliver funnel in its operating position.

11. Apparatus according to claim 10, wherein said transport arrangement includes a feed roll and a feed table that is urged by spring elements against the feed roll, on which feed table the sliver funnel is applied in its operating position.

12. Apparatus according to claim 2, wherein said transport arrangement includes a feed roll and a feed table that is urged by spring elements against the feed roll, on which feed table the sliver funnel is applied in its operating position.

13. Apparatus according to claim 12, wherein the sliver funnel bears on the feed table in such a way that the latter can be moved away from the feed roll by supplementary loading of the sliver funnel.

14. Apparatus according to claim 12, wherein one of the sliver funnel and the feed table has a grip or the like that extends out from the housing to accommodate manual gripping and movement thereof.

15. Feeding apparatus for a spinning assembly comprising:

a transport arrangement for delivering sliver to an opener device and which forms a nip for the sliver presented to the opener device, a housing surrounding said transport arrangement, and a sliver funnel disposed upstream of said transport arrangement, said sliver funnel having an outlet opening which leads to the transport arrangement, wherein the sliver funnel is pivotally mounted on a shaft that is disposed crosswise with reference to the direction of travel of sliver through said sliver funnel so as to be swingably movable about said shaft between an operating position with said outlet opening in the vicinity of the transport arrangement and a servicing position with said outlet opening exposed to the outside of said housing for accommodating visual inspection of the position of the sliver inserted in the sliver funnel without requiring opening of said housing, whereby sliver can be laid correctly in said sliver funnel without requiring opening of said housing for the transport arrangement.

16. Feeding apparatus for a spinning assembly comprising:

a transport arrangement for delivering sliver to an opener device and which forms a nip for the sliver presented to the opener device, a housing surrounding said transport arrangement, a sliver funnel disposed upstream of said transport arrangement, said sliver funnel having an outlet opening which leads to the transport arrangement, and a stationary sliver feed tube disposed upstream of the sliver funnel, wherein said sliver funnel is movable from its operating position into a servicing position where it lies as an extension of the stationary feed tube with said outlet opening exposed for accommodating visual inspection of the sliver inserted in the sliver funnel, whereby sliver can be laid correctly in said sliver funnel without requiring opening of said housing for the transport arrangement.

17. Feeding apparatus for a spinning assembly comprising:

a transport arrangement for delivering sliver to an opener device and which forms a nip for the sliver presented to the opener device, a housing surrounding said transport arrangement, and a sliver funnel disposed upstream of said transport arrangement, said sliver funnel having an outlet opening which leads to the transport arrangement, wherein the housing has an opening through which the sliver funnel is accessible from the outside, wherein the sliver funnel is movable out of the housing through the opening into a predetermined servicing position and particularly for accommodating the threading of the sliver, and wherein the opening of the housing is at a side of the sliver funnel which can be moved out of the housing, crosswise with reference to the sliver funnel's guide passage to a position where said outlet opening is exposed for accommodating visual inspection of the position of the sliver inserted in the sliver funnel, whereby sliver can be laid correctly in said sliver funnel without requiring opening of said housing for the transport arrangement.

18. Apparatus according to claim 17, wherein the sliver funnel is held in the housing by a slide rod that runs crosswise to the direction of travel of sliver through the guide passage of said sliver funnel, said slide rod forming a part of said sliver funnel guide means.

19. Apparatus according to claim 18, wherein the sliver funnel is swingably borne about the slide rod.

20. Apparatus according to claim 17, wherein said transport arrangement includes a feed roll and a feed table that is urged by spring elements against the feed roll, on which feed table the sliver funnel is applied in its operating position.

21. Feeding apparatus for a spinning assembly comprising:

a transport arrangement for delivering sliver to an opener device and which forms a nip for the sliver presented to the opener device, a housing surrounding said transport arrangement, and a sliver funnel disposed upstream of said transport arrangement, said sliver funnel having an outlet opening which leads to the transport arrangement, wherein the transport arrangement includes a feed table and a feed roll, and wherein the sliver funnel and the feed table and feed roll constitute a structural unit that is movable out of the housing by way of a slide rod which holds them, said structural unit being movable between an operating position and a servicing position with said outlet opening exposed to the outside of said housing for accommodating visual inspection of the position of the sliver inserted in the sliver funnel, whereby sliver can be laid correctly in said sliver funnel without requiring opening of said housing for the transport arrangement.

22. Apparatus according to claim 21, wherein elastic means are provided for holding the sliver funnel in its operating position.

23. Feeding apparatus for a spinning assembly comprising:

a transport arrangement for delivering sliver to an opener device and which forms a nip for the sliver presented to the opener device, a housing surrounding said transport arrangement, and a sliver funnel disposed upstream of said transport arrangement, said sliver funnel having an outlet opening which leads to the transport arrangement, wherein said sliver funnel is movable between an operating position with said outlet opening in the vicinity of the transport arrangement and a servicing position with said outlet opening exposed to the outside of said housing for accommodating visual inspection of the position of the sliver inserted in the sliver funnel, without requiring opening of said housing, whereby sliver can be laid correctly in said sliver funnel without requiring opening of said housing for the transport arrangement, and wherein securing aligning means are provided for securing the sliver funnel in its servicing position.

24. Feeding apparatus for a spinning assembly comprising:

a transport arrangement for delivering sliver to an opener device and which forms a nip for the sliver presented to the opener device, a housing surrounding said transport arrangement, and a sliver funnel disposed upstream of said transport arrangement, said sliver funnel having an outlet opening which leads to the transport arrangement, wherein the housing has an opening through which the sliver funnel is accessible from the outside, wherein the opening of the housing is disposed at a side of the sliver funnel, and wherein the sliver funnel is composed of two parts that are separated in the longitudinal direction thereof and can be moved apart from one another to accommodate visual inspection of the position of the sliver inserted in the sliver funnel, whereby sliver can be laid correctly in said sliver funnel without requiring opening of said housing for the transport arrangement.

25. Apparatus according to claim 24, wherein one part of the sliver funnel is made as a hinged cover.

26. Apparatus according to claim 25, wherein said transport arrangement includes a feed roll and a feed table that is urged by spring elements against the feed roll, on which feed table the sliver funnel is applied in its operating position.

27. Feeding apparatus for a spinning assembly comprising:

a transport arrangement for delivering sliver to an opener device and which forms a nip for the sliver presented to the opener device, a housing surrounding said transport arrangement, and a sliver funnel disposed upstream of said transport arrangement, said sliver funnel having an outlet opening which leads to the transport arrangement, wherein said transport arrangement includes a feed roll and a feed table that is urged by spring elements against the feed roll, on which feed table the sliver funnel is applied in its operating position, wherein the sliver funnel bears on the feed table in such a way that the latter can be moved away from the feed roll by supplementary loading of the sliver funnel, and wherein the sliver funnel is movable crosswise with reference to the direction of travel of the sliver, said sliver funnel presenting an elongated guide rib that is applied to the feed table even in the servicing position of the sliver funnel.

* * * * *